US007571611B2

(12) United States Patent
Johnson et al.

(10) Patent No.: US 7,571,611 B2
(45) Date of Patent: Aug. 11, 2009

(54) METHODS AND SYSTEM FOR REDUCING PRESSURE LOSSES IN GAS TURBINE ENGINES

(75) Inventors: David Martin Johnson, Simpsonville, SC (US); Kenneth Neil Whaling, Simpsonville, SC (US); Ronald Scott Bunker, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 460 days.

(21) Appl. No.: 11/409,807

(22) Filed: Apr. 24, 2006

(65) Prior Publication Data

US 2007/0245741 A1 Oct. 25, 2007

(51) Int. Cl.
*F23R 3/00* (2006.01)

(52) U.S. Cl. ..... 60/772; 60/39.37; 60/752; 60/757; 60/760

(58) Field of Classification Search ..... 60/39.37, 60/752, 755, 756, 757, 760, 772
See application file for complete search history.

(56) References Cited

U.S. PATENT DOCUMENTS 3,793,827 A * 2/1974 Ekstedt ..... 60/757
3,811,276 A * 5/1974 Caruel et al. ..... 60/757
4,077,205 A * 3/1978 Pane et al. ..... 60/757
4,719,748 A * 1/1988 Davis et al. ..... 60/39.37
4,821,387 A * 4/1989 Bouillot et al. ..... 60/757
4,872,312 A 10/1989 Iizuka et al.
5,085,038 A * 2/1992 Todman et al. ..... 60/39.37
5,454,221 A 10/1995 Loprinzo
5,575,154 A 11/1996 Loprinzo
6,224,329 B1 * 5/2001 North ..... 415/116
6,484,505 B1 11/2002 Brown et al.
6,540,477 B2 4/2003 Glynn et al.
6,594,999 B2 * 7/2003 Mandai et al. ..... 60/752
7,010,921 B2 3/2006 Intile et al.
2001/0032453 A1 * 10/2001 Tatsumi et al. ..... 60/752
2002/0172591 A1 11/2002 Glynn et al.
2004/0079082 A1 * 4/2004 Bunker ..... 60/752
2005/0081526 A1 4/2005 Howell et al.
2005/0144953 A1 7/2005 Martling et al.
2005/0268613 A1 12/2005 Intile et al.
2005/0268615 A1 12/2005 Bunker et al.
2006/0283189 A1 * 12/2006 Lipinski et al. ..... 60/760

FOREIGN PATENT DOCUMENTS

JP 10-54257 * 2/1998

* cited by examiner

*Primary Examiner*—Ted Kim
(74) *Attorney, Agent, or Firm*—Armstrong Teasdale LLP

(57) ABSTRACT

A method of assembling a combustor assembly is provided, wherein the method includes providing a combustor liner having a centerline axis and defining a combustion chamber therein, and coupling an annular flowsleeve radially outward from the combustor liner such that an annular flow path is defined substantially circumferentially between the flowsleeve and the combustor liner. The method also includes orienting the flowsleeve such that a plurality of inlets formed within the flowsleeve are positioned to inject cooling air in a substantially axial direction into the annular flow path to facilitate cooling the combustor liner.

20 Claims, 5 Drawing Sheets

METHODS AND SYSTEM FOR REDUCING PRESSURE LOSSES IN GAS TURBINE ENGINES

BACKGROUND OF THE INVENTION

This invention relates generally to gas turbine engines and more particularly, to combustor assemblies for use with gas turbine engines.

At least some known gas turbine engines use cooling air to cool a combustion assembly within the engine. Moreover, often the cooling air is supplied from a compressor coupled in flow communication with the combustion assembly. More specifically, in at least some known gas turbine engines, the cooling air is discharged from the compressor into a plenum extending at least partially around a transition piece of the combustor assembly. A first portion of the cooling air entering the plenum is supplied to an impingement sleeve surrounding the transition piece prior to entering a cooling channel defined between the impingement sleeve and the transition piece. Cooling air entering the cooling channel is discharged into a second cooling channel defined between a combustor liner and a flowsleeve. The remaining cooling air entering the plenum is channeled through inlets defined within the flowsleeve prior to also being discharged into the second cooling channel.

Within the second cooling channel, the cooling air facilitates cooling the combustor liner. At least some known flowsleeves include inlets and thimbles that are configured to discharge the cooling air into the second cooling channel at an angle that is substantially perpendicular to the flow of the first portion of cooling air entering the second cooling chamber. More specifically, because of the different flow orientations, the second portion of cooling air loses axial momentum and may create a barrier to the momentum of the first portion of cooling air. The barrier may cause substantial dynamic pressure losses in the air flow through the second cooling channel.

At least one known approach to decreasing the amount of pressure losses requires resizing the inlets in the existing system. However, this approach may require multiple inlets to be resized at multiple sections of the engine. As such, the economics of this approach may outweigh any potential benefits.

BRIEF DESCRIPTION OF THE INVENTION

In one aspect, a method of assembling a combustor assembly is provided, wherein the method includes providing a combustor liner having a centerline axis and defining a combustion chamber therein, and coupling an annular flowsleeve radially outward from the combustor liner such that an annular flow path is defined substantially circumferentially between the flowsleeve and the combustor liner. The method also includes orienting the flowsleeve such that a plurality of inlets formed within the flowsleeve are positioned to inject cooling air in a substantially axial direction into the annular flow path to facilitate increasing dynamic pressure recovery.

In another aspect, a combustor assembly is provided, wherein the combustor assembly includes a combustor liner having a centerline axis and defining a combustion chamber therein. The combustor liner also includes an annular flowsleeve coupled radially outward from the combustor liner such that an annular flow path is defined substantially circumferentially between the flowsleeve and the combustor liner. The flowsleeve includes a plurality of inlets configured to inject cooling air therefrom in a substantially axial direction into the annular flow path to facilitate increasing dynamic pressure recovery.

In a further aspect, a gas turbine engine is provided, wherein the gas turbine engine includes a combustor assembly including a combustor liner having a centerline axis and defining a combustion chamber therein. The combustor assembly also includes an annular flowsleeve coupled radially outward from the combustor liner such that an annular flow path is defined substantially circumferentially between the flowsleeve and the combustor liner. The flowsleeve includes a plurality of inlets configured to inject cooling air therefrom in a substantially axial direction into the annular flow path to facilitate increasing dynamic pressure recovery.

DETAILED DESCRIPTION OF THE INVENTION

As used herein, "upstream" refers to a forward end of a gas turbine engine, and "downstream" refers to an aft end of a gas turbine engine.

Figure 1:
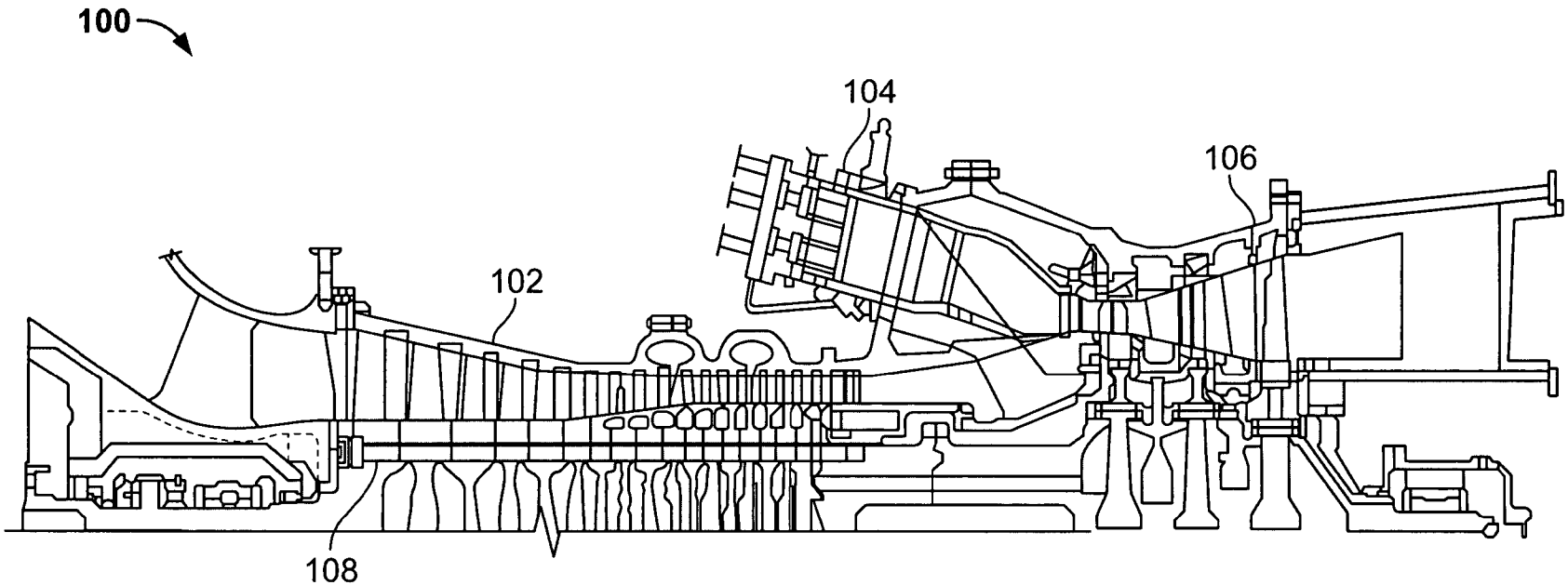
FIG. 1 is a schematic cross-sectional illustration of an exemplary gas turbine engine.

FIG. 1 is a schematic cross-sectional illustration of an exemplary gas turbine engine 100. Engine 100 includes a compressor assembly 102, a combustor assembly 104, a turbine assembly 106 and a common compressor/turbine rotor shaft 108. It should be noted that engine 100 is exemplary only, and that the present invention is not limited to engine 100 and may instead be implemented within any gas turbine engine that functions as described herein.

In operation, air flows through compressor assembly 102 and compressed air is discharged to combustor assembly 104. Combustor assembly 104 injects fuel, for example, natural gas and/or fuel oil, into the air flow, ignites the fuel-air mixture to expand the fuel-air mixture through combustion and generates a high temperature combustion gas stream. Combustor assembly 104 is in flow communication with turbine assembly 106, and discharges the high temperature expanded gas stream into turbine assembly 106. The high temperature expanded gas stream imparts rotational energy to turbine assembly 106 and because turbine assembly 106 is rotatably coupled to rotor 108, rotor 108 subsequently provides rotational power to compressor assembly 102.

Figure 2:
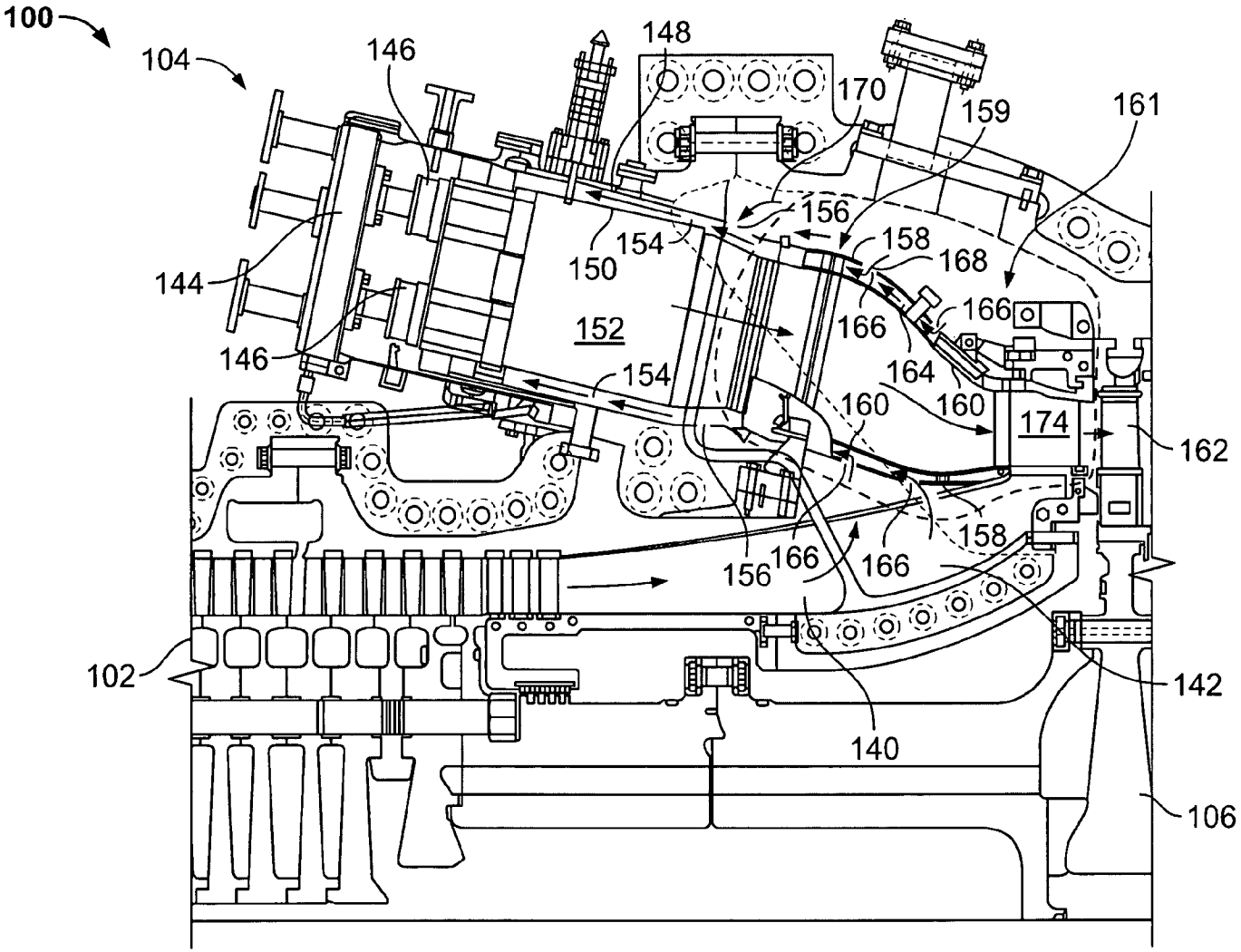
FIG. 2 is an enlarged cross-sectional illustration of a portion of an exemplary combustor assembly that may be used with the gas turbine engine shown in FIG. 1.

FIG. 2 is an enlarged cross-sectional illustration of a portion of combustor assembly 104. Combustor assembly 104 is coupled in flow communication with turbine assembly 106 and with compressor assembly 102. Compressor assembly 102 includes a diffuser 140 and a discharge plenum 142, that are coupled to each other in flow communication to facilitate channeling air downstream to combustor assembly 104 as discussed further below.

In the exemplary embodiment, combustor assembly 104 includes a substantially circular dome plate 144 that at least partially supports a plurality of fuel nozzles 146. Dome plate 144 is coupled to a substantially cylindrical combustor flowsleeve 148 with retention hardware (not shown in FIG. 2). A substantially cylindrical combustor liner 150 is positioned within flowsleeve 148 and is supported via flowsleeve 148. A substantially cylindrical combustor chamber 152 is defined by liner 150. More specifically, liner 150 is spaced radially inward from flowsleeve 148 such that an annular combustion liner cooling passage 154 is defined between combustor flowsleeve 148 and combustor liner 150. Flowsleeve 148 includes a plurality of inlets 156 which provide a flow path into cooling passage 154.

An impingement sleeve 158 is coupled substantially concentrically to combustor flowsleeve 148 at an upstream end 159 of impingement sleeve 158, and a transition piece 160 is coupled to a downstream end 161 of impingement sleeve 158. Transition piece 160 facilitates channeling combustion gases generated in chamber 152 downstream to a turbine nozzle 174. A transition piece cooling passage 164 is defined between impingement sleeve 158 and transition piece 160. A plurality of openings 166 defined within impingement sleeve 158 enable a portion of air flow from compressor discharge plenum 142 to be channeled into transition piece cooling passage 164.

In operation, compressor assembly 102 is driven by turbine assembly 106 via shaft 108 (shown in FIG. 1). As compressor assembly 102 rotates, it compresses air and discharges compressed air into diffuser 140 as indicated in FIG. 2 with a plurality of arrows. In the exemplary embodiment, the majority of air discharged from compressor assembly 102 is channeled through compressor discharge plenum 142 towards combustor assembly 104, and a smaller portion of air discharged from compressor assembly 102 is channeled downstream for use in cooling engine 100 components. More specifically, a first flow leg 168 of the pressurized compressed air within plenum 142 is channeled into transition piece cooling passage 164 via impingement sleeve openings 166. The air is then channeled upstream within transition piece cooling passage 164 and discharged into combustion liner cooling passage 154. In addition, a second flow leg 170 of the pressurized compressed air within plenum 142 is channeled around impingement sleeve 158 and injected into combustion liner cooling passage 154 via inlets 156. Air entering inlets 156 and air from transition piece cooling passage 164 is then mixed within passage 154 and is then discharged from passage 154 into fuel nozzles 146 wherein it is mixed with fuel and ignited within combustion chamber 152.

Flowsleeve 148 substantially isolates combustion chamber 152 and its associated combustion processes from the outside environment, for example, surrounding turbine components. The resultant combustion gases are channeled from chamber 152 towards and through a transition piece combustion gas stream guide cavity 160 that channels the combustion gas stream towards turbine nozzle 174.

Figure 3:
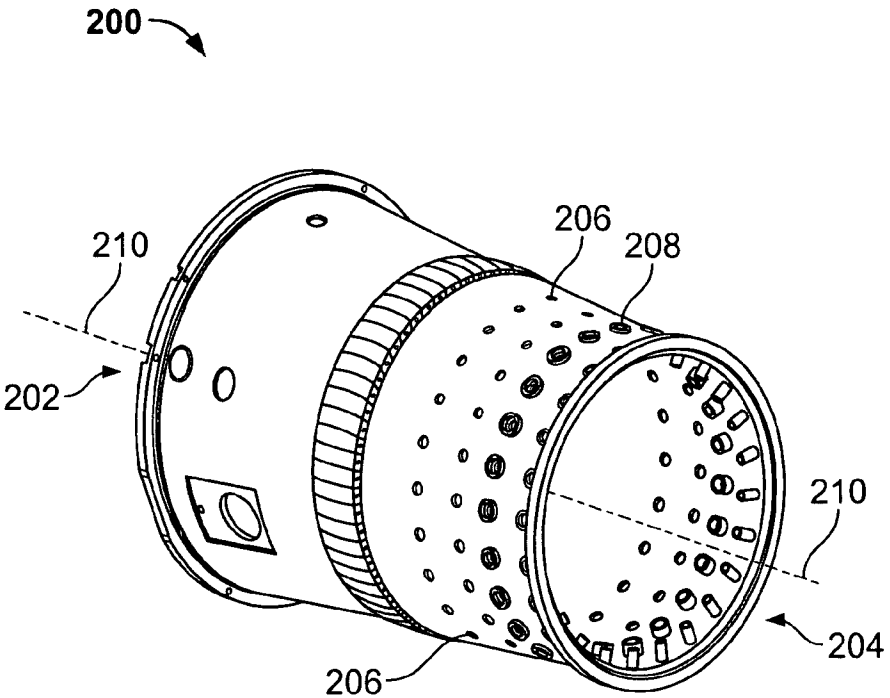
FIG. 3 (Prior Art)
FIG. 3 is a perspective view of a known flowsleeve that may be used with the combustor assembly shown in FIG. 2.

FIG. 3 is a perspective view of a known flowsleeve 200 that may be used with combustor assembly 104. Flowsleeve 200 is substantially cylindrical and includes an upstream end 202 and a downstream end 204. Upstream end 202 is coupled to dome plate 144 (shown in FIG. 2) and downstream end 204 is coupled to impingement sleeve 158 (shown in FIG. 2). Combustor liner 150 (shown in FIG. 2) is coupled radially inward from flowsleeve 200 such that cooling passage 154 (shown in FIG. 2) is defined between flowsleeve 200 and combustor liner 150.

Flowsleeve 200 also includes a plurality of inlets 206 and thimbles 208 defined adjacent downstream end 204. Inlets 206 and thimbles 208 are substantially circular and are oriented substantially perpendicular to a flowsleeve center axis 210. Furthermore, thimbles 208 extend substantially radially inward from flowsleeve 200 such that airflow is discharged from thimbles 208 and inlets 206 from around impingement sleeve 158, radially inward through flowsleeve 200, and into combustion liner cooling passage 154. The radial flow direction of airflow entering passage 154 through inlets 206 and thimbles 208 substantially reduces the axial momentum of airflow and creates a barrier to air flowing within passage 154 from transition piece cooling passage 164. Furthermore, the radial length of thimbles 208 creates an obstruction to airflow channeled from transition piece cooling passage 164. As such, a pressure drop of the airflow results within combustion cooling passage 154. The resulting pressure drop may cause disproportional cooling around combustor liner 150.

Figure 4:
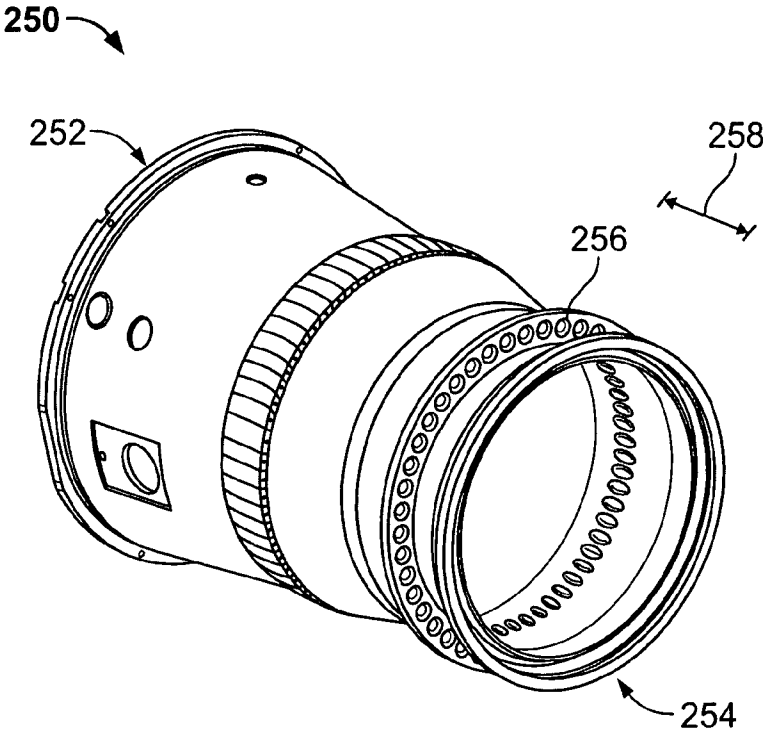
FIG. 4 is a perspective view of an exemplary flowsleeve that may be used with the combustor assembly shown in FIG. 2.

FIG. 4 is a perspective view of an exemplary embodiment of a flowsleeve 250 that may be used with combustor assembly 104. Flowsleeve 250 is substantially cylindrical and includes an upstream end 252 and a downstream end 254. Upstream end 252 is coupled to dome plate 144 (shown in FIG. 2) and downstream end 254 is coupled to impingement sleeve 158 (shown in FIG. 2). Combustor liner 150 (shown in FIG. 2) is coupled radially inward from flowsleeve 250 such that combustion liner cooling passage 154 (shown in FIG. 2) is defined between flowsleeve 250 and combustor liner 150.

Flowsleeve 250 also includes a plurality of injectors 256 spaced circumferentially about flowsleeve 250 at a distance 258 upstream from downstream end 254. In the exemplary embodiment, injectors 256 are substantially circular and each has a large length/diameter ratio. In an alternative embodiment, injectors 256 are substantially rectangular slots having a width that is larger than a slot height. Moreover, injectors 256 are configured to substantially axially eject airflow from around impingement sleeve 158 through flowsleeve 250 and into combustion liner cooling passage 154. More specifically, airflow ejected from injectors 256 enters passage 154 in a generally axial direction that is substantially tangential to a direction of flow discharged into passage 154 from airflow channeled into passage 154 from passage 164, and in substantially the same direction as airflow channeled into passage 154 from passage 164. Furthermore, injectors 256 are configured to accelerate airflow ejected therefrom. An annular gap (not shown) is defined between flowsleeve 250 and combustor liner 150 within distance 258. Injectors 256 and the annular gap facilitate regulating pressure in airflow entering combustion liner cooling passage 154.

Figure 5:
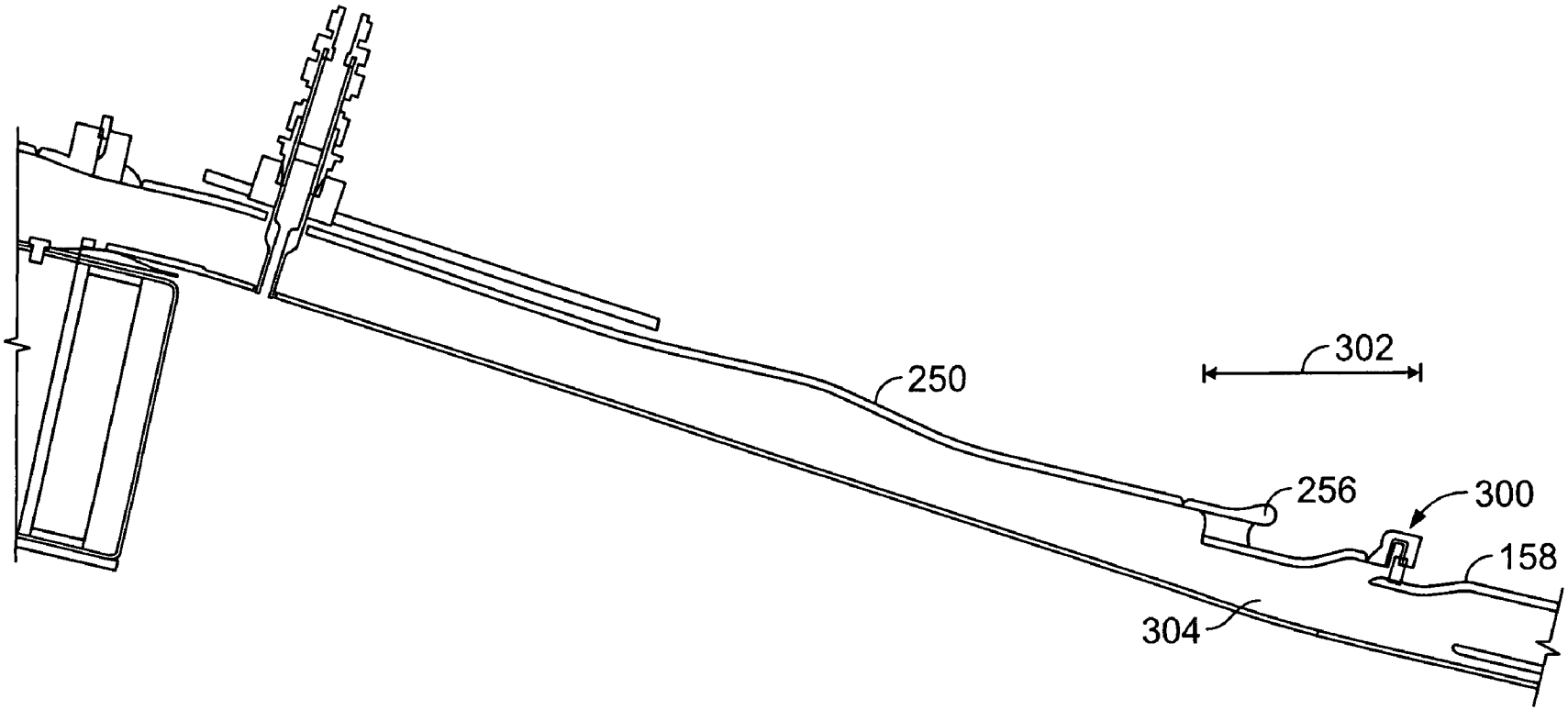
FIG. 5 is a cross-sectional view of an exemplary flowsleeve and an impingement sleeve/flowsleeve interface that may be used with the combustor assembly shown in FIG. 2.

FIG. 5 is a cross-sectional view of flowsleeve 250 and an impingement sleeve/flowsleeve interface 300. Specifically, FIG. 5 illustrates the interface 300 defined between the coupling of flowsleeve 250 and impingement sleeve 158. Furthermore FIG. 5 illustrates a cross-sectional view of the axial injection geometry of injectors 256. Specifically, flowsleeve 250 is oriented such that injectors 256 are positioned an axial distance 302 upstream from interface 300. As such, an annular gap 304 defined at the intersection region of flowsleeve 250 and impingement sleeve 158 has an axial length 302. Annular gap 304 facilitates regulating air flow from transition piece cooling passage 164.

Figure 6:
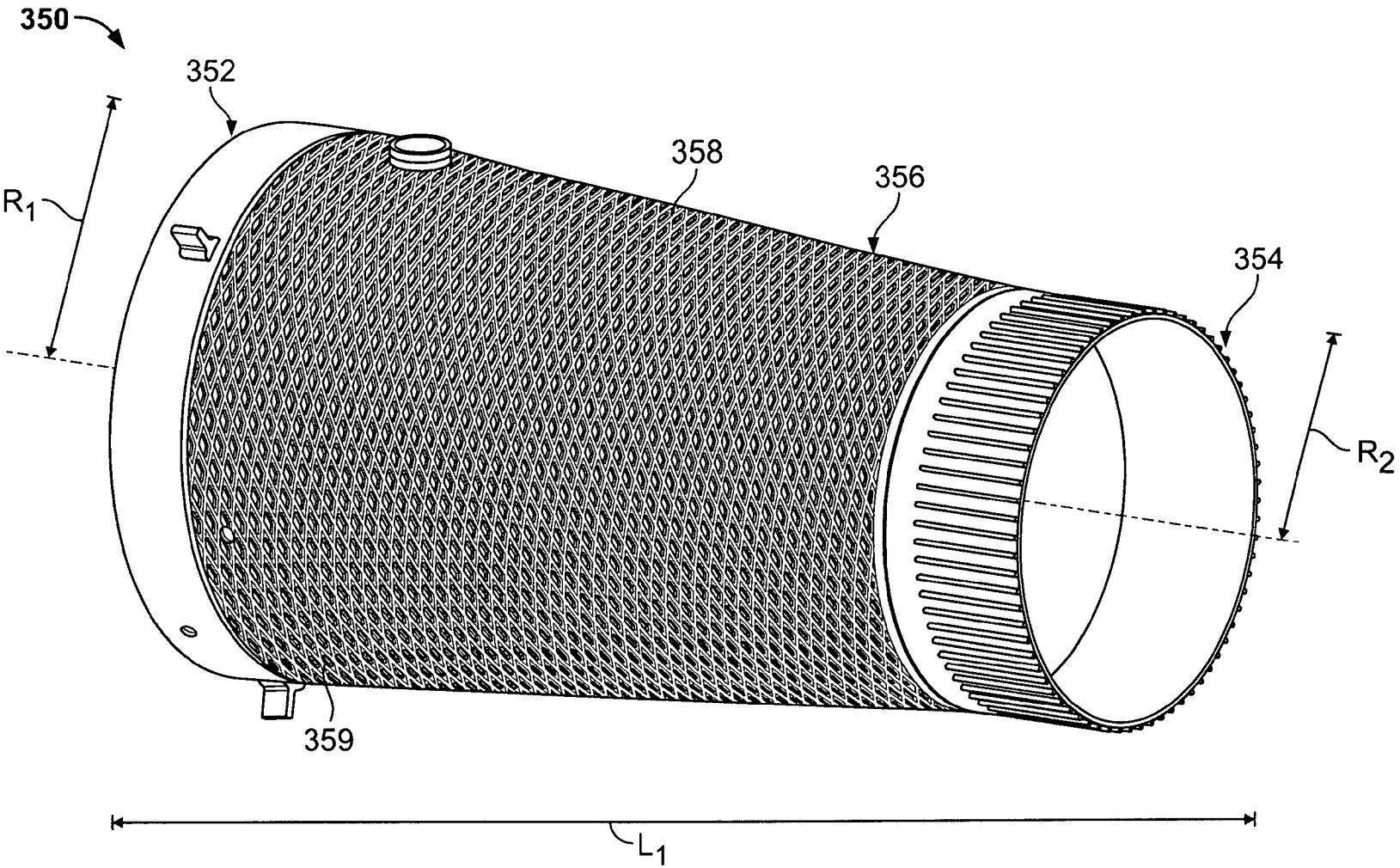
FIG. 6 is a perspective view of an exemplary combustor liner that may be used with the combustor assembly shown in FIG. 2.

FIG. 6 is a perspective view of an exemplary combustor liner 350 that may be used with combustor assembly 104. Combustor liner 350 is substantially cylindrical and includes an upstream end 352 and a downstream end 354. In the exemplary embodiment, upstream end 352 has a radius $R_1$ that is substantially larger than a radius $R_2$ of downstream end 354. Upstream end 352 receives a fuel/air mixture from fuel nozzles 146 and discharges the fuel/air mixture into transition piece 160. Combustor liner 350 is oriented within flowsleeve 250 such that flowsleeve 250 and combustor liner 350 define combustion liner cooling passage 154. Cooling air received in combustion liner cooling passage 154 is channeled upstream and across a surface 356 of combustor liner 350 to facilitate cooling combustor liner 350.

Combustor liner surface 356 is configured with a plurality of grooves 358 defined thereon that facilitate circumferentially distributing the airflow from injectors 256 across liner surface 356. In the exemplary embodiment, grooves 358 are configured in a criss-crossed pattern across a length $L_1$ of combustor liner surface 356 such that diamond shaped raised portions 359 are defined between grooves 358. In alternative embodiments, grooves 358 may be configured in other geometrical patterns.

During operation of engine 100 cooling air is discharged from plenum 142 such that it substantially surrounds impingement sleeve 158. First flow leg 168 enters transition piece cooling passage 164 through openings 166. First flow leg 168 cools transition piece 160 by traveling upstream through transition piece cooling passage 164. First flow leg 168 continues through annular gap 304 and discharges into combustion liner cooling passage 154. Second flow leg 170 flows around impingement sleeve 158 and enters combustion liner cooling passage 154 through injectors 256. Within combustion liner cooling passage 154, the first and second flow legs 168 and 170 mix and continue upstream to facilitate cooling combustor liner 350.

The configuration of injectors 256 increases the velocity of cooling air within second flow leg 170. The increased velocity facilitates enhanced heat transfer between the cooling air and combustor liner 350. Annular gap 304 facilitates regulating flow of first flow leg 168 into combustion cooling passage 154. As such, injectors 256 and annular gap 304 facilitate balancing the pressure and velocity of the two flow legs 168 and 170 such that a balanced flow path results from the mixing of the two flow paths.

Furthermore, due to the axial configuration of injectors 256, the second flow leg 170 does not create an air darn which restricts the flow of first flow leg 168. As a result, the axial configuration of injectors 256 facilitates increasing dynamic pressure recovery within the resultant flow path. By balancing pressure loss and velocity within combustion liner cooling passage 154, injectors 256 and annular gap 304 facilitate substantially uniform heat transfer between combustor liner 350 and the cooling air.

Moreover, grooves 358 of combustor liner surface 356 facilitate enhancing the heat transfer between cooling air and combustor liner 350. Specifically, grooves 358 facilitate circumferentially distributing cooling air from injectors 256 and facilitate creating a uniform heat transfer coefficient distribution across the length and circumference of combustor liner 350. In addition, grooves 358 facilitate allowing high velocity cooling air to facilitate improving heat transfer.

The above-described apparatus and methods facilitate providing constant heat transfer between cooling air and a combustor liner, while maintaining an overall pressure of the gas turbine engine. Specifically, the injectors facilitate reducing pressure losses by injecting the cooling air of the second flow leg axially such that dynamic pressure recovery is increased between the first and second flow leg. Furthermore, the enhancements to the combustor liner facilitate greater heat exchange between the combustor liner and the cooling air.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of a combustor assembly for a gas turbine engine, it is understood that the apparatus and methods are not limited to combustor assemblies or gas turbine engines. Likewise, the combustor assembly components illustrated are not limited to the specific embodiments described herein, but rather, components of the combustor assembly can be utilized independently and separately from other components described herein.

While the invention has been described in terms of various specific embodiments, those skilled in the art will recognize that the invention can be practiced with modification within the spirit and scope of the claims.

What is claimed is:

1. A method of assembling a combustor assembly, said method comprising:

providing a combustor liner having a centerline axis and defining a combustion chamber therein;

coupling an annular flowsleeve radially outward from the combustor liner such that an annular flow path is defined substantially circumferentially between the flowsleeve and the combustor liner; and orienting the flowsleeve such that a plurality of inlets formed within the flowsleeve are positioned to inject cooling air in a substantially axial direction into the annular flow path to facilitate increasing dynamic pressure recovery within the flow path, wherein the inlets are oriented substantially parallel to the centerline axis and each has a length that is longer than a diameter of the inlet; the inlets being positioned radially outside a gap receiving air from a transition piece.

2. A method in accordance with claim 1 further comprising:

coupling the transition piece to the combustor liner; and coupling an impingement sleeve radially outward from the transition piece such that a transition piece cooling flow path is defined between the transition piece and the impingement sleeve.

3. A method in accordance with claim 2 further comprising:

creating an annular flow gap between the combustor liner and the flowsleeve to facilitate regulating flow from the transition piece cooling flow path into the annular flow path.

4. A method in accordance with claim 3 further comprising orienting the plurality of flowsleeve inlets to facilitate reducing flow turbulence within the annular gap.

5. A method in accordance with claim 2 further comprising orienting the plurality of inlets to facilitate reducing inlet losses and facilitate increasing cooling of the transition piece.

6. A method in accordance with claim 1 further comprising orienting the plurality of inlets to facilitate increasing a velocity of cooling air discharged therefrom.

7. A method in accordance with claim 1 further comprising providing surface enhancements across an outer surface of the combustor liner to facilitate increasing heat transfer between the combustor liner and cooling air flowing through the annular flow path.

8. A combustor assembly comprising:

a combustor liner having a centerline axis and defining a combustion chamber therein; and an annular flowsleeve coupled radially outward from said combustor liner such that an annular flow path is defined substantially circumferentially between said flowsleeve and said combustor liner, said flowsleeve comprises a plurality of inlets configured to inject cooling air therefrom in a substantially axial direction into said annular flow path to facilitate cooling said combustion liner, each of said plurality of inlets is oriented substantially parallel to the centerline axis, each of said plurality of inlets comprises a length and a diameter, each said inlet length is longer than each said inlet diameter; the inlets being positioned radially outside a gap receiving air from a transition piece.

9. A combustor assembly in accordance with claim 8 further comprising:

the transition piece coupled to said combustor liner; and an impingement sleeve coupled radially outward from said transition piece such that an annular transition piece cooling flow path is defined between said transition piece and said impingement sleeve, said transition piece cooling flow path configured facilitate increasing dynamic pressure recovery within said flow path.

10. A combustor assembly in accordance with claim 9 further comprising an annular flow gap defined between said combustor liner and said flowsleeve, said annular flow gap configured to regulate flow from said transition piece cooling flow path into said annular flow path.

11. A combustor assembly in accordance with claim 8 wherein said plurality of inlets facilitate reducing flow turbulence within said annular flow path.

12. A combustor assembly in accordance with claim 9 wherein said plurality of inlets facilitate increasing cooling of said transition piece within said annular flow path.

13. A combustor assembly in accordance with claim 8 wherein said plurality of inlets are each substantially circular and facilitate increasing a velocity of cooling air discharged therefrom.

14. A combustor assembly in accordance with claim 8 wherein an exterior surface of said combustor liner comprises surface enhancements that facilitate increasing heat transfer between said combustor liner and cooling air flowing through said annular flow path.

15. A gas turbine engine comprising:

a combustor assembly comprising:

a combustor liner having a centerline axis and defining a combustion chamber therein; and an annular flowsleeve coupled radially outward from said combustor liner such that an annular flow path is defined substantially circumferentially between said flowsleeve and said combustor liner, said flowsleeve comprises a plurality of inlets configured to inject cooling air therefrom in a substantially axial direction into said annular flow path to facilitate increasing dynamic pressure recovery of said flow path, each of said plurality of inlets is oriented substantially parallel to the centerline axis, each of said plurality of inlets comprises a length and a diameter, each said inlet length is longer than each said inlet diameter; the inlets being positioned radially outside a gap receiving air from a transition piece.

16. A gas turbine engine in accordance with claim 15 wherein said combustor assembly further comprises the transition piece coupled to said combustor liner; and an impingement sleeve coupled radially outward from said transition piece such that an annular transition piece cooling flow path is defined between said transition piece and said impingement sleeve, said transition piece cooling flow path configured to facilitate cooling said combustor liner.

17. A gas turbine engine in accordance with claim 16 wherein said combustor assembly further comprises an annular flow gap defined between said combustor liner and said flowsleeve, said annular flow gap configured to regulate flow from said transition piece cooling flow path into said annular flow path.

18. A gas turbine engine in accordance with claim 16 wherein said plurality of inlets facilitate reducing inlet losses and facilitate increasing cooling of said transition piece within said annular flow path.

19. A gas turbine engine in accordance with claim 15 wherein said plurality of inlets are each substantially circular and facilitate increasing a velocity of cooling air discharged therefrom.

20. A gas turbine engine in accordance with claim 15 wherein an exterior surface of said combustor liner comprises surface enhancements that facilitate increasing heat transfer between said combustor liner and cooling air flowing through said annular flow path.

* * * * *

UNITED STATES PATENT AND TRADEMARK OFFICE

CERTIFICATE OF CORRECTION

PATENT NO. : 7,571,611 B2
APPLICATION NO. : 11/409807
DATED : August 11, 2009
INVENTOR(S) : Johnson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 480 days.

Signed and Sealed this

Seventh Day of September, 2010

David J. Kappos

David J. Kappos
*Director of the United States Patent and Trademark Office*